US005661932A

United States Patent [19]

Barefield

[11] Patent Number: 5,661,932

[45] Date of Patent: Sep. 2, 1997

[54] POST ANCHOR AND METHOD OF INSTALLING A POST

[76] Inventor: David H. Barefield, 1605 Palm Dr., Avon Park, Fla. 33825

[21] Appl. No.: 631,971

[22] Filed: Apr. 15, 1996

[51] Int. Cl.[6] ..... E02D 5/80

[52] U.S. Cl. ..... 52/154; 52/155; 52/156; 52/158; 52/166; 403/374

[58] Field of Search ..... 52/154, 155, 165, 52/156, 158, 159, 166; 403/374, 371

[56] References Cited

U.S. PATENT DOCUMENTS

| | | | |
|---|---|---|---|
| 373,240 | 11/1887 | Logan | 52/154 |
| 1,599,745 | 9/1926 | Cinnamond | 52/155 |
| 2,107,835 | 2/1938 | Pierce | 403/374 X |
| 3,157,407 | 11/1964 | Aulabaugh | 403/374 X |
| 3,328,976 | 7/1967 | Shoemaker et al. | 403/374 X |
| 3,342,444 | 9/1967 | Nelson | 52/154 |
| 4,753,411 | 6/1988 | Lechner et al. | 52/165 X |
| 4,882,891 | 11/1989 | Sero et al. | 52/154 X |
| 5,525,005 | 6/1996 | Chen | 403/374 |

*Primary Examiner*—Wynn E. Wood
*Assistant Examiner*—W. Glenn Edwards

[57] ABSTRACT

A post anchor adaptable to impact insertion into the earthen ground to rigidly support a post extending above ground level. The post anchor is functional without requiring the use of concrete to reinforce the post anchor within the earthen ground. A driveable member and a locking member cooperate to form each post anchor. A post engaging channel cooperates with a plurality of ground engaging fins and a sub-grade surface to provide displacement resistance properties to the post anchor. The resistance properties include the sub-grade surface compacting the earthen ground during and following installation and restricting displacement of earthen ground over the ground engaging fins following installation. A secure attachment, using the locking member, occurs to secure the post to the driveable member following placement of both the post and the driveable member during the installation procedure. The driveable member may be of a one piece construction, as would result from a molding process, or construction of the driveable member may be from a sheet material. When construction of the driveable member is of a sheet material, the sheet material is subjected to a deforming process to render definable unique panels thereon definable from adjacent panels by a linear juncture. Either a single sheet piece or multiple sheet pieces form the driveable member. An installation aid permits easy insertion of the driveable member into the earthen ground. The post anchor permits repositioning of the post relative to the driveable member following installation.

9 Claims, 13 Drawing Sheets

*FIG. 17*

FIG. 9
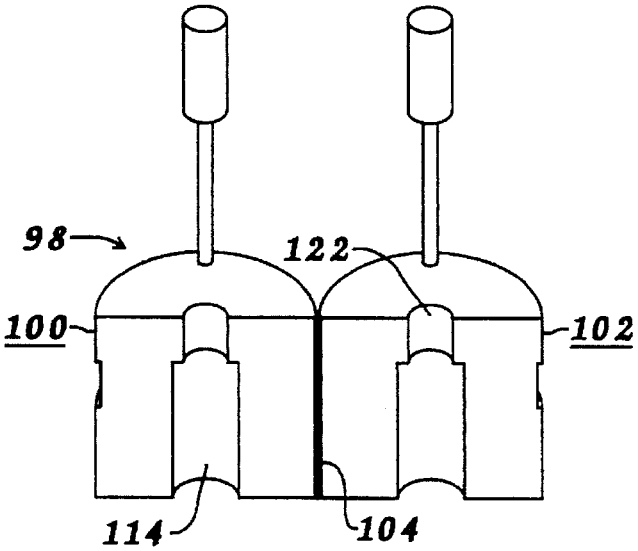
FIG. 10
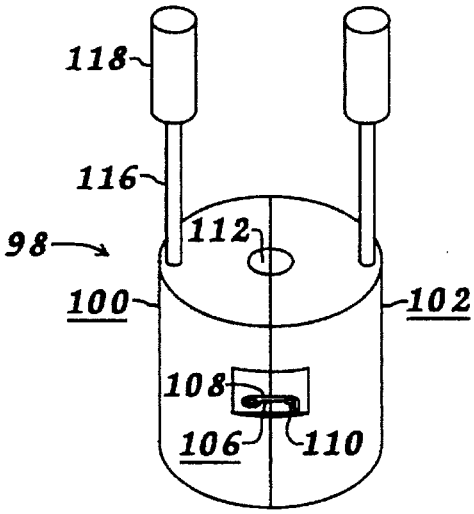
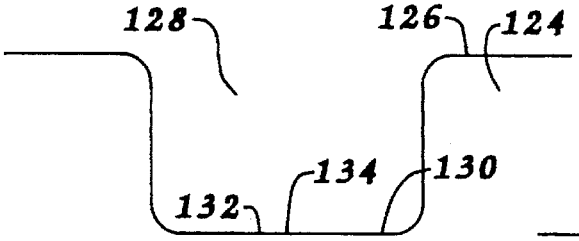
FIG. 11
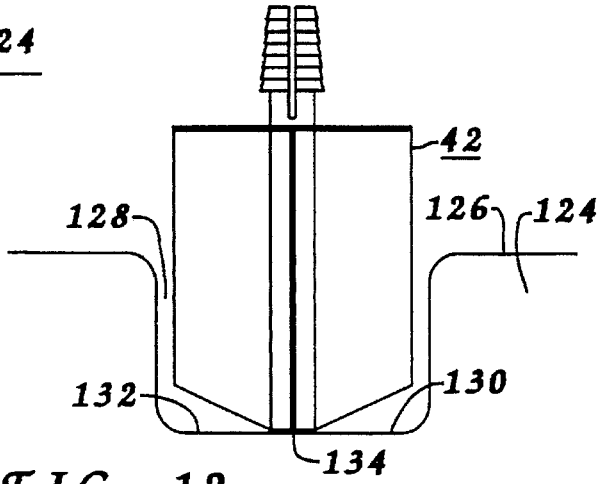
FIG. 12

POST ANCHOR AND METHOD OF INSTALLING A POST

BACKGROUND

1. Field of the Invention

Generally, the invention relates to anchoring posts in the earthen ground. More specifically, the invention relates to post anchors which are driveable and adaptable for deployment without requiring the use of concrete.

2. Description of the Prior Art

The anchoring of posts in the earthen ground satisfies various needs. The attachment of signs to the post, as exampled by signs posted in yard advertising the availability of the property for sale, is one common example. Similarly, the attachment of signs to posts along roads advise motorists of various conditions or that various provisions of laws are in effect for that specific stretch of road. Common examples of these type of signs include 'stop' signs and signs notifying motorists of the 'posted' speed limits in effect.

Turning now to posts which support structural entities rather than signs, the most common structure supporting use of posts is to support fencing. In this usage, a configuration of a plurality of posts cooperate to provide for an aligned linear arrangement. A common usage involves various linear sections which cooperate to define a perimeter which surrounds and encloses an area.

In the agricultural area, posts enclose areas with barbed wire or a heavy gauge wire mesh fencing spanning and attached to each post in succession. This usage provides for the containment of animals such as cows, horses and pigs.

In the residential area, posts enclose areas with chain link or boarding spanning and attached to each post in succession. This usage commonly defines a section of the boundaries of the subject property, as exampled by enclosing the backyard of a home. This usage is extremely common due to the desire of people to restrict ingress and egress from their property.

The most common method in current use of anchoring a post into the earthen ground comprises the following steps. Digging of a deep narrow hole into the ground occurs. Following forming of this hole, insertion of a post into the hole occurs. Then the placement of concrete to radially surround the post occurs to at least partially fill the hole. Following the setting of this concrete, generally the following day, installation of the fencing material occurs to span a plurality of such installed posts and define the fence.

Several disadvantages exist with this method which make the method less efficient than desired. Sandy soil conditions tend to expand the upper extent of the hole beyond the desired size. There is a requirement of special motorized digging equipment which eliminates the requirement of manually scooping out the dirt with post hole diggers. The labor expense involved with the digging of the holes, using either method, is significant. The requirement of mixing concrete at the job site is time consuming, expensive and messy. There is a requirement that even a simple job must span multiple days due to the requirement that the concrete harden prior to attachment of the fencing material.

Various attempts have been made to provide a structural device capable of placement into the earthen ground for attachment thereto of a post. These devices attempt to provide various large surface areas distributed in the ground to cooperate to act to resist motion of the device while in the earthen ground.

Generally, acceptance in the industry of these devices is lacking. They are difficult to install. They lack sufficient resistance properties once installed to acceptably resist motion of the post above the ground. They are prohibitively expensive when compared to the conventional dig and concrete method. These devices also lack the versatility to permit the elevation of the post to be easily adjusted relative to the fixed anchor device following installation.

For these reasons there remains a need for a simple anchor device which is adaptable for installation into the earthen ground with minimal labor consumption, which provide for acceptable motion resistance within the earthen ground following installation and which also permit repositioning of the elevation of the post relative to the fixed anchor device without requiring repositioning of the anchor device within the ground. The present invention substantially fulfills these needs.

SUMMARY OF THE INVENTION

In view of the foregoing disadvantages inherent in the conventional method of securing post in the earthen ground, your applicant has devised a driveable post anchor to overcome those disadvantages. The driveable post anchors applicable to the instant invention have several features in common. Each post anchor is comprised of a driveable member and a locking member. The driveable member must present a vertical linear alignment permitting ready impact generated insertion into the earthen ground. The driveable member must have sufficient vertically oriented surface areas, in the form of ground engaging fins, to restrict lateral displacement within the earthen ground following installation. The driveable member must have a sub-grade surface situated proximate the upper edges of the ground engaging fins to prevent displacement of earthen soil over the ground engaging fins. The driveable member must have a post engaging channel penetrating the sub-grade surface to slidably receive the post. The locking member must be accessible above the sub-grade surface during and following attachment. The locking member provides for attachment of the post, within the post engaging channel, at a desired elevational height relative to the driveable member.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The primary object of the present invention is to provide for a post anchor which will anchor a post in the earthen ground.

Other objects include;

a) to provide for installation of a driveable member, being part of the post anchor, with a minimal of effort.

b) to provide for immediate usage of the post anchor following installation without requiring passage of a setting time interval.

c) to provide for impact force generated insertion of the driveable member into the earthen ground.

d) to provide for large vertically oriented surface areas distributed within the earthen ground to resist movement of the post anchor, and therefore the post, following installation.

e) to provide for the various features of the post anchor to cooperate to provide resistance to vertical motion of the extending attached post.

f) to provide for a sub-grade surface to restrict displacement of earthen ground over the large vertically oriented surface areas to enhance the resistance properties of the vertically oriented surface areas.

g) to provide for the driveable member to slidably receive the post, within a post engaging channel, to permit movement of the post and the driveable member relative to one another during the installation process.

h) to provide for securing the post within the post engaging channel to lock the post at a desired elevational position relative to the driveable member of the post anchor.

i) to provide for a post anchor having a one piece driveable member as formed by a molding process having the required features of the invention.

j) to provide for at least one sheet piece cut and bent or stamped, having only planar surfaces, to permit assembly to form the driveable member of a post anchor having the required features of the invention.

k) to provide for at least two sheet pieces cut and bent or stamped, having only planar surfaces, to permit attachment together and assembly to form the driveable member of the post anchor having the required features of the invention.

l) to provide for at least one sheet piece cut and stamped, and having curved and planar surfaces thereon, to permit assembly to form the driveable member of the post anchor having the required features of the invention.

m) to provide for at least two sheet pieces cut and stamped, and having curved and planar surfaces thereon, to permit attachment together and assembly to form the driveable member of the post anchor having the required features of the invention.

n) to provide for impact driven installation of the driveable member of the post anchor into the earthen ground using a partially driven post as a guide.

o) to provide for a manually operated sliding impact member, utilizing the post as an insertion guide, to provide the impact force to drive the driveable member of the post anchor into the earthen ground.

p) to provide for a pneumatic powered impact member, utilizing the post as an insertion guide, to provide the impact force to drive the driveable member of the post anchor into the earthen ground.

q) to provide for an electrically powered impact member, utilizing the post as an insertion guide, to provide the impact force to drive the driveable member of the post anchor into the earthen ground.

r) to provide for cutting to remove sections of the driveable member of the post anchor to allow installation adjacent an obstruction.

s) to provide for the reuse of the driveable member of the post anchor following removal from the earthen ground.

t) to provide for the anchoring of posts in marshy areas where the ground is saturated with water and use of concrete is not possible or desirable.

u) to provide for anchoring posts having any cross section profile including round, oval, square or rectangular.

v) to provide for the readjustment of the elevational height of the post at any time following initial installation without requiring movement of the driveable member of the post anchor.

w) to provide for applying a texture to the inside surface of the post engaging channel to enhance gripping of the post following installation.

x) to provide for applying a material to the inside surface of the post engaging channel to enhance gripping of the post following installation.

y) to provide for insertion of an insert within the post engaging channel to enhance gripping properties between the post engaging channel and the post.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 9 is a perspective view of a driving member shown in an open position.

FIG. 10 is a perspective view of the driving member shown in FIG. 9 in a closed position.

FIG. 11 through FIG. 18 are side plan views illustrating steps of an installation procedure.

DESCRIPTION

Figure 1:
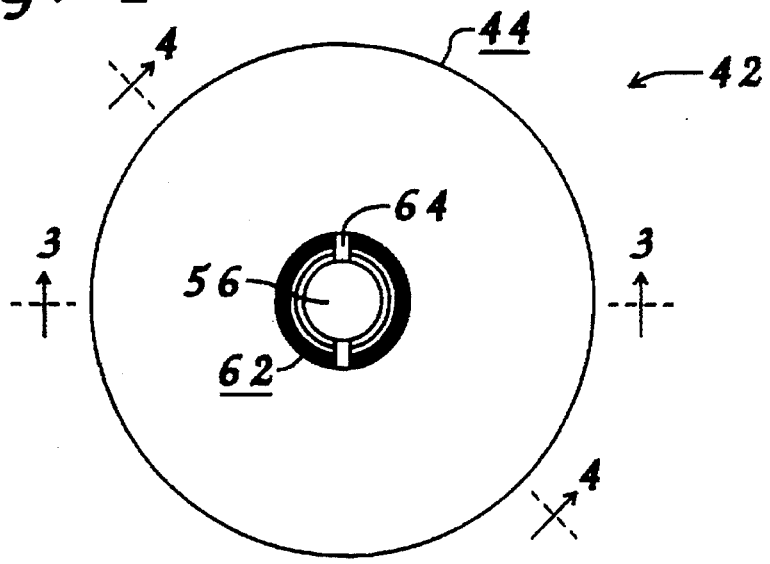
FIG. 1 is an overhead plan view of a driveable member.
Figure 2:
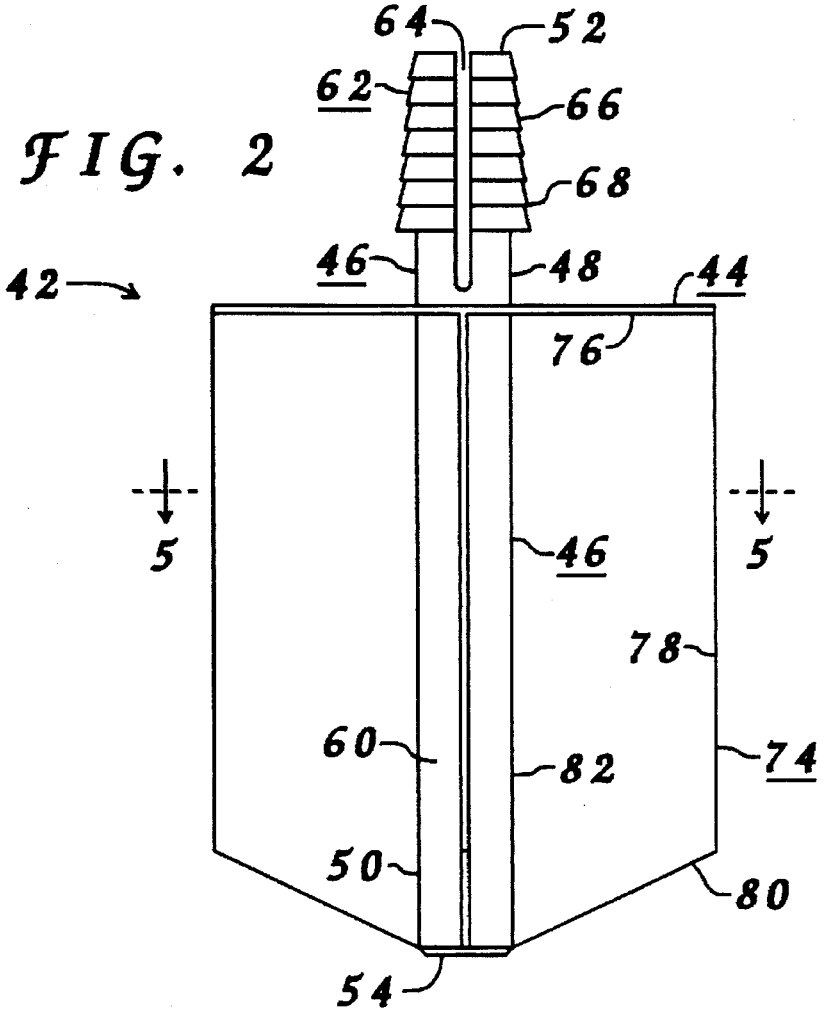
FIG. 2 is a side plan view of the driveable member shown in FIG. 1.
Figure 3:
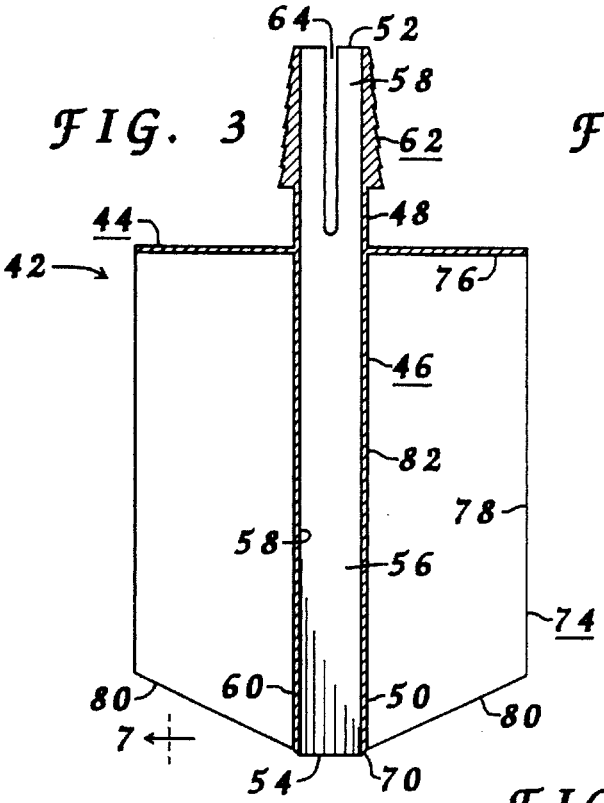
FIG. 3 is a sectional plan view as taken from the section lines '3' shown in FIG. 1 with the sectioning taking place slightly off center of the driveable member and just in front of the opposing ground engaging fins.
Figure 4:
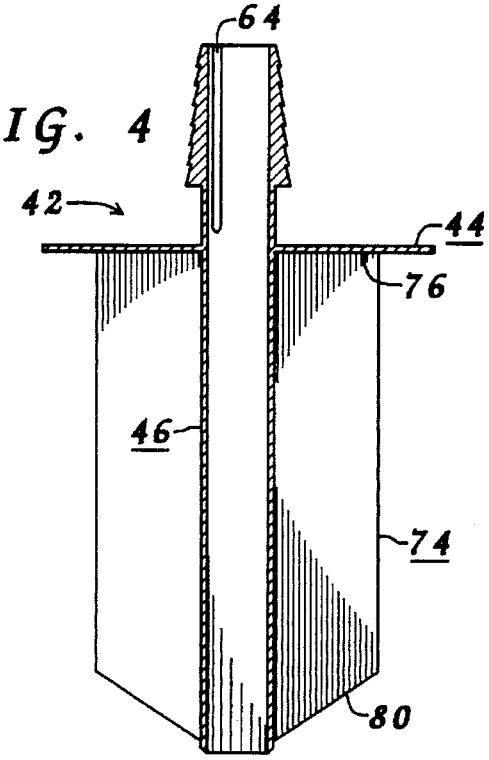
FIG. 4 is a sectional plan view as taken from the section lines '4' shown in FIG. 1.

Reference is now made to the drawings where like reference numerals refer to like parts throughout the various views. Each post anchor of the instant invention comprises a driveable member and a locking member. The driveable member must have a plurality of ground engaging fins, must have a sub-grade surface secured proximate the upper edges of the ground engaging fins, must have a post engaging channel penetrating the sub-grade surface. The locking member during and following attachment must be accessible above the sub-grade surface. A separate description of each of these features follows.

FIG. 1 through FIG. 7 show a driveable member 42, or sectional views taken therefrom, adaptable to forming in a molding process in a single piece. FIG. 19 through FIG. 25, FIG. 29 through FIG. 33 and FIG. 34 through FIG. 37 show driveable members 180, 235 and 284 respectively, or sectional views taken therefrom. Each driveable member 180, 235 and 284 are adaptable to forming from a sheet material. The sheet material is cut and bent or stamped, to permit assembly from at least one of the sheet material pieces. Driveable members 180, 235 and 284 have similar features to driveable member 42. The feature requirements of the following description, while specifically directed to driveable member 42, are applicable to any driveable member of the instant invention including driveable members 180, 235 and 284. Post anchors of the instant invention comprise a driveable member and a locking member.

Posts applicable to the instant invention may have any cross section shape including round, oval, square or rectangular. The posts may be hollow or solid and construction may be of any suitable material such as wood, metal or plastic. In use, anchoring of the post into the earthen ground, with a post anchor secured to the post proximate the buried end of the post, occurs. The opposing end of the post, the upper post, remains exposed above the earthen ground. This exposed part of the post performs some desired function, depending upon the designated usage of the post. There are two directional possibilities for the application of pressure to the upper post. The first, and most common, is a horizontally applied pressure. The second, rarely applicable under normal conditions depending upon usage of the post, is a vertically applied pressure, either upward or downward. The disclosed post anchors have features which will satisfactorily resist downward pressure while resisting upward pressure. The primary function of the instant invention is to resist the application of horizontal pressure to the upper post exposed above the earthen ground.

During the application of significant horizontally directed pressure to the upper post, the post and the post anchor will attempt to move within the earthen ground. It is necessary to provide resistance to this movement in order to securely anchor the post into the earthen ground.

Many uses of post, as exampled by supporting fencing, provide for restriction of movement along a linear alignment of the supporting structure. The accompanying structure attached to a sequence of posts act to prevent movement of each individual post toward or away from adjacent posts. Therefore, in these uses, there are directions of horizontal movement which rely upon the post anchor to a lesser extent to prevent movement of the upper post than other directions of horizontal movement.

Ground engaging fins

The ground engaging fins have several functions with the primary function being to provide the post anchor with resistance properties to lateral displacement within the earthen ground. Each ground engaging fin relies upon two features to resist this pressure. The first feature is exposing a surface area to the earthen ground. The second feature resides within a cooperation with adjacent intersecting ground engaging fins to trap and compress earthen ground between the intersecting ground engaging fins. In usage, several ground engaging fins will resist movement simultaneously regardless of the direction of the application of pressure.

As detailed below within FIG. 38*a* through FIG. 38*l* and FIG. 39*a* through FIG. 39*h*, numerous configurations of ground engaging fins are possible. Preferably, distribution of the ground engaging fins is symmetrical on opposing hemispheres of the driveable member. While the preferred number of ground engaging fins is four, other numbers of ground engaging fins are possible.

Preferably, the ground engaging fins attach, using their upper extent, to the lower surface of the sub-grade surface. It is also possible to have ground engaging fins extending above the sub-grade surface, or even have them penetrating the sub-grade surface, to continue upward. One example of ground engaging fins extending upward from the sub-grade surface involves a radial offset of the upper ground engaging fins relative to the ground engaging fins below the sub-grade surface.

Figure 6:
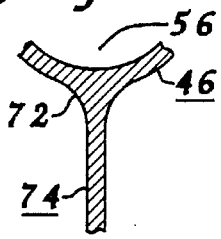
FIG. 6 is an enlarged overhead sectional plan view of a ground engaging fin extending from a post engaging channel.
Figure 7:
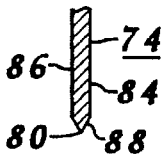
FIG. 7 is an enlarged sectional plan view as taken from the section line '7' shown in FIG. 3.
Figure 5:
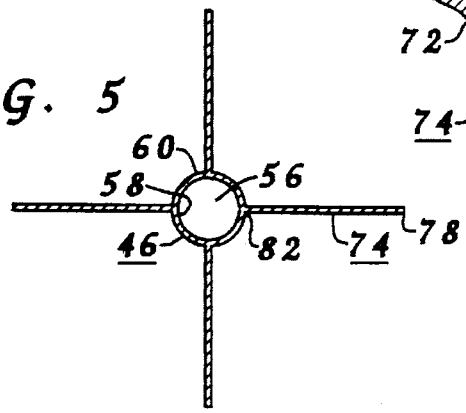
FIG. 5 is a sectional plan view as taken from the section lines '5' shown in FIG.

A plurality of ground engaging fins 74 contact a post engaging channel 46 along an inner edge 82 of each ground engaging fin 74. As shown in FIG. 6, preferably a reinforcing section 72 strengthens the attachment of each ground engaging fin 74 to post engaging channel 46. Preferably, a similar strengthening reinforcement of the connection between each ground engaging fin 74 and a sub-grade surface 44 exists. Each ground engaging fin 74, as shown in FIG. 7, has a first side 84, a second side 86 and a lower edge 80. Preferably, lower edge 80 has a taper 88 between first side 84 and second side 86 which enhances the insertion properties of driveable member 42 during installation. As an enhancement to insertion, lower edge 80 preferably is angled upward while extending away from post engaging channel 46. Each ground engaging fin 74 has an upper edge 76 which attaches to sub-grade surface 44. Each ground engaging fin 74 has an outer edge 78 which is preferably parallel to inner edge 82. As shown in FIG. 5, the cross section profile of driveable member 42 is such that ready insertion into earthen ground may occur with minimal earthen ground displacement.

Sub-grade surface

The sub-grade surface has several functions including to prevent the passage of earthen ground over the top of the ground engaging fin. Another function is to compress the earthen ground firmly beneath the driveable member. Still another function is to secure the ground engaging fins to strengthen the ground engaging fins to permit resistance to movement without yielding. Yet another function is to resist upward displacement of the post anchor which is the final movement before full removal from the earthen ground. Still another function is to provide additional weight on the driveable member from the soil compacted on top of the sub-grade surface. Another function is to provide resistance to downward settling or sinking of the driveable member into the earthen ground. Still another function is to compact soil when driven into contact with the excavated grade to pack soil around the ground engaging fins. Yet another function is to resist downward movement during the application of horizontally directed pressure to the post. This resistance prevents the post anchor, with the attached post, from moving further into the earthen ground.

The sub-grade surface may have numerous shapes including round, square, oval and rectangular depending, in part, upon the specific requirements of the intended usage. Preferably the sub-grade surface is a planar, or flat, surface. A dome shape provides better earthen ground containment for certain installations. Similarly, a downturn proximate the perimeter, forming a surrounding lip, enhances earthen ground displacement resistance properties.

Post engaging channel 46 penetrates sub-grade surface 44. Sub-grade surface 44 has each ground engaging fin 74 secured thereto. Sub-grade surface 44 may extend to exactly cover each ground engaging fin 74, as shown. Variation in this coverage is possible, as shown in FIG. 38*a* through FIG. 38*l*, depending upon the specific requirements of the intended usage.

Post engaging channel

The post engaging channel has the primary function of contacting, and restricting, the post to the driveable member. The post engaging channel must penetrate the sub-grade surface. This provides access above the sub-grade surface to lock the post to the driveable member following installation. Several possibilities exist for placement of the ground engaging fins relative to the post engaging channel. The ground engaging fins may attach directly to the post engaging channel. The ground engaging fins may attach indirectly using an intermediate member. The ground engaging fins may form the post engaging channel. This is disclosed below within FIG. 19 through FIG. 37, for the various example driveable members of the composite post anchors.

Figure 17:
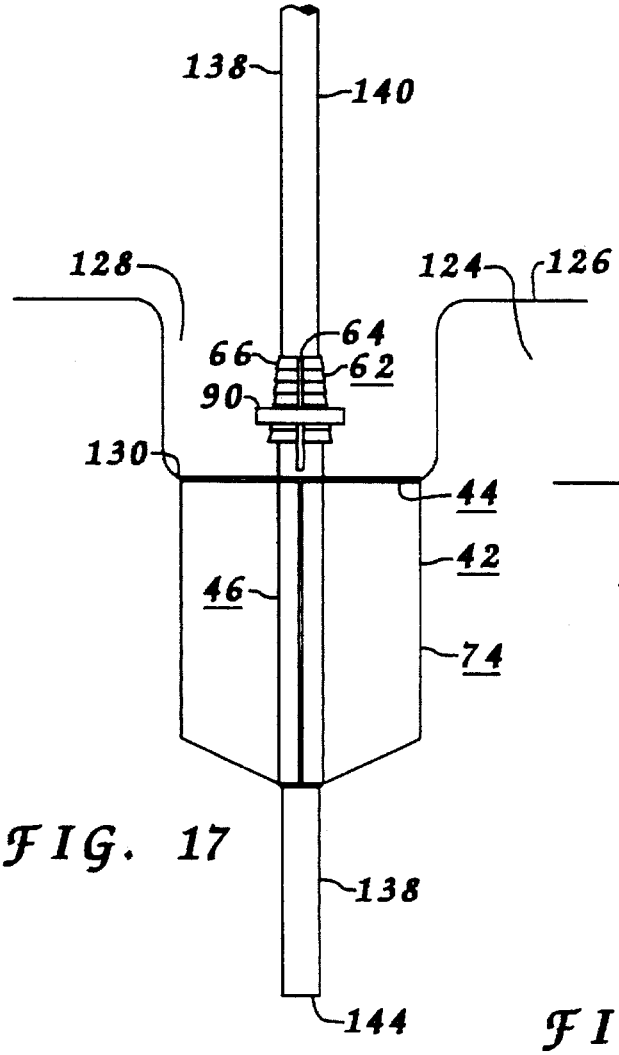
Figure 18:
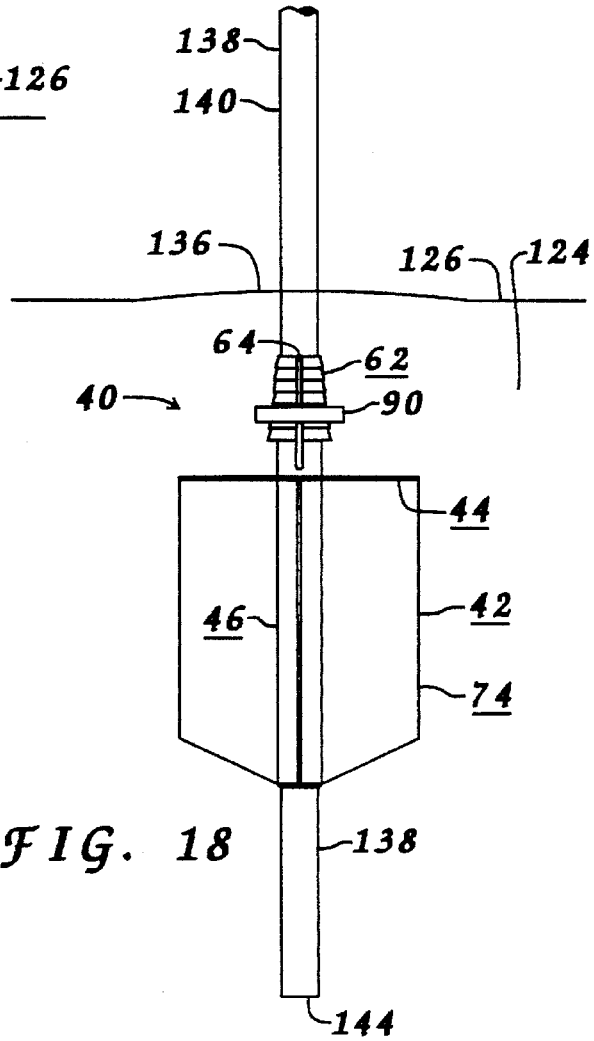

Post engaging channel 46 has a first end 48 and a second end 50. Situated on first end 48 is a securing collar 62 which has opposing compression slots 64 and a plurality of raised sections 66. Compression slots 64 begin at an upper extent 52 and extend along post engaging channel 46. Compression slots 64 are of a sufficient length and width to permit deforming the opposing sides of post engaging channel 46. This allows post engaging channel 46 to engage a post, as shown in FIG. 17 and FIG. 18, to securely engage a post 138. Extending along post engaging channel 46, commencing at first end 48, are a grouping of raised sections 66 each having an engaging lip 68. Each successive raised section 66 has a slightly greater diametric measurement than the prior raised section 66.

Post engaging channel 46 has an open passage 56 extending from upper extent 52 to a lower extent 54. Open passage 56 is of a slightly greater diametric size than the outside diametric size of the intended post size. Post engaging channel 46 has an inner surface 58 and an outer surface 60. Lower extent 54 is the terminal end of post engaging channel 46 and has a taper 70 radially disposed between inner surface 58 and outer surface 60. Taper 70 enhances the insertion properties of driveable member 42 during installation.

Locking member

The locking member acts to secure the post within the post engaging channel to prevent movement of the post relative to the driveable member. Numerous methods exist to secure the post within the post engaging channel. A particularly expedient method is to have deforming compression of the post engaging channel. This deforming compression provides for friction bonding between the post engaging channel and the post. This method permits ready release, adjustment of the elevation of the post relative to the driveable member of the post anchor, and resecurement at the new elevational position.

The various post engaging channels may have the securing collar incorporated thereon. Alternatively, the securing collar may be a separate securing collar clip which attaches to the post engaging channel. The separate securing collar clip allows application of a deforming pressure thereto. Use of a separate securing collar clip allows the driveable members of the composite post anchors to enjoy the same readjustment and resecurement properties as those disclosed below.

Figure 8:
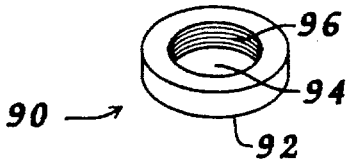
FIG. 8 is a perspective view of a locking member.

Referring now to FIG. 8, a locking member 90 comprises a ring 92 having an aperture 94 penetrating thereon with engaging ridges 96 radially disposed within aperture 94. While a plurality of engaging ridges 96 are disclosed, a single engaging feature is all that is required to facilitate locking. In use, ring 92 is placed over the post and brought into contact with securing collar 62. Ring 92 is forced downward while compression slots 64 deforms inward. Engaging lips 68 engage engaging ridges 96 to secure ring 92 to driveable member 42. This results in a retention of compression slots 64 in their deformed position.

Following installation, even following the passage of an extended period of time, locking member 90 may be cut to release the securement between driveable member 42 and the post. Then, repositioning of the post elevationally and securement of the post to driveable member 42 at the new elevational position using a new locking member 90 may occur. Other methods of securing the post to the driveable member may be employed without departing from the spirit of the invention.

Installation aids

Several methods provide for insertion into the earthen ground of the driveable members having features of the instant invention. Manual insertion, without any installation aids, will provide for adequate installation. Preferably, insertion occurs evenly without any rocking of the driveable member. Such rocking loosens the earthen ground around the driveable member. Adaptation of a drive member provides for proper insertion into the earthen ground. The drive member is manually moved upward and downward, or is powered, as exampled by a pneumatic or electrical drive. Driving of the post into the earthen ground first allows the post to act as a guide for the driveable member to aid in even insertion. This initial driving of the post is to a depth less than the desired final depth. Such initial driving preferably is to a depth sufficient to permit the post to act as a sturdy guide during insertion of the driveable member.

One example of a drive member provides for manual manipulation thereof to slide up and down on the post while delivering driving blows on the downward strokes. A penetrating aperture on the drive member receives the post and permits the post to act as a guide during movement upward and downward. The drive member may have an impact surface radially disposed at a sufficient spacing about a penetrating aperture. This spacing prevents contact with the post engaging channel exposed above the sub-grade surface. This prevents the possibility of damage to the post engaging channel during installation. It is possible to have upper ground engaging fins above the sub-grade surface on the driveable member. In this instance it may be preferable to have a spacer unit to act as an intermediary between the driveable member and the drive member. In such a configuration, the lower side would have indentations to receive the upper ground engaging fins. The upper side would present a smooth surface to receive the blows.

FIG. 9 and FIG. 10 illustrate a driving member 98 having a first half 100 and a second half 102 pivotally attached using a hinge 104. First half 100 and second half 102 each have a post guide 122 and a protection chamber 114. When closed, retention of first half 100 and second half 102 in a closed position occurs because of a latch 106 comprising a hook 108 and a peg 110. In the closed position the opposing post guides 122 cooperate to form a post aperture 112 which may slidably receive a post, not shown. It is desirable to be able to gain access to post aperture 112 to position the post therein. This eliminates the requirement of lifting driving member 98 over the upper terminus of the post during installation of the driveable member.

Driving member 98 has opposing connection members 116 each having a grip 118 secured thereon. In use, post aperture 112 of driving member 98 is placed on the post so that the installer may manipulate driving member 98. Such manipulation uses grips 118 to repetitively deliver impact blows to driveable member 42. These impact blows force driveable member 42 into the earthen ground.

Installation procedure

Some installed posts perform a desired function without cooperation with other installed posts. The most common example of this usage is to support a planar display surface having a message affixed thereon. Some installed posts perform their intended function in cooperation with the other installed posts in a series. The most common example of this usage is to support fencing material spanning the series and connected along the exposed vertical length of each post.

With varying degrees of accuracy, depending upon usage, a determination of a position of placement for each installation of the driveable member and the associative post occurs. Within the linear alignment for fencing support this determination must be to a relatively high degree of accuracy.

Figure 13:
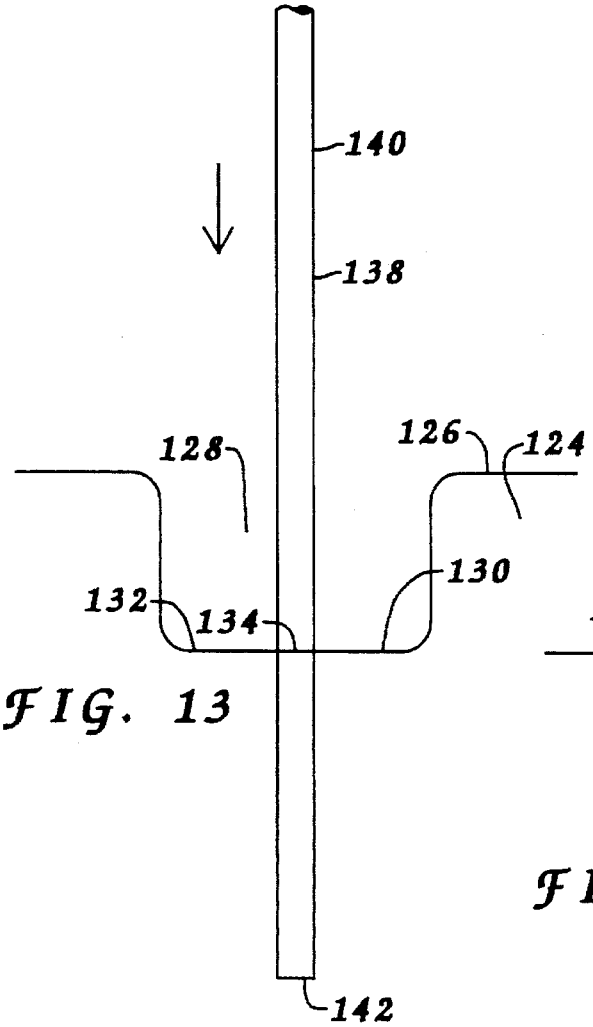

FIG. 11 through FIG. 18 depict a typical installation with the optional selection of either the step of FIG. 12 or the step of FIG. 13. The first step is to select the position of installation of post 138 into earthen ground 124 on a grade 126. At this position the installer digs a shallow hole to form an excavated hole 128 having a diametric measurement slightly greater than the diametric measurement of driveable member 42. Excavated hole 128 has a base 130 having an excavated grade 132 which the installer will ensure is relatively smooth. A determination of a position of post placement 134 on base 130 directly relating vertically to the original position on grade 126 then occurs.

At this point, a selection of one of two steps occurs. Using the first choice, driveable member 42 is situated in excavated hole 128 corresponding to position of post placement 134, as shown in FIG. 12. Using the second choice, which is the preferred method, driving of post 138 into base 130 of excavated hole 128 at position of post placement 134 to a first driven depth 142 occurs. First driven depth 142 is a depth measured from grade 126 which is less than a final driven depth 144, shown in FIG. 16 through FIG. 18. Using this method, access must be available to the upper extent of post 138 to permit a sliding installation of driveable member 42 over post 138. If an obstruction on post 138 exists, such as a sign, then driveable member 42 is first positioned in excavated hole 128. Placement of post 138 through driveable member 42 then occurs and a driving of post 138 to first driven depth 142 occurs, as shown in FIG. 14.

When such an obstruction exists on post 138 and the locking means being utilized must slidably mount post 138 it becomes necessary to position locking member 90 so that it is positioned for attachment to driveable member 42 following insertion of post 138 and driveable member 42 into earthen ground 124, not shown. This would be accomplished by either placing looking member 90 on driveable member 42 without deforming compression slots 64 or sliding looking member 90 onto post 138 from the bottom then inserting post 138 through driveable member 42.

Figure 14:
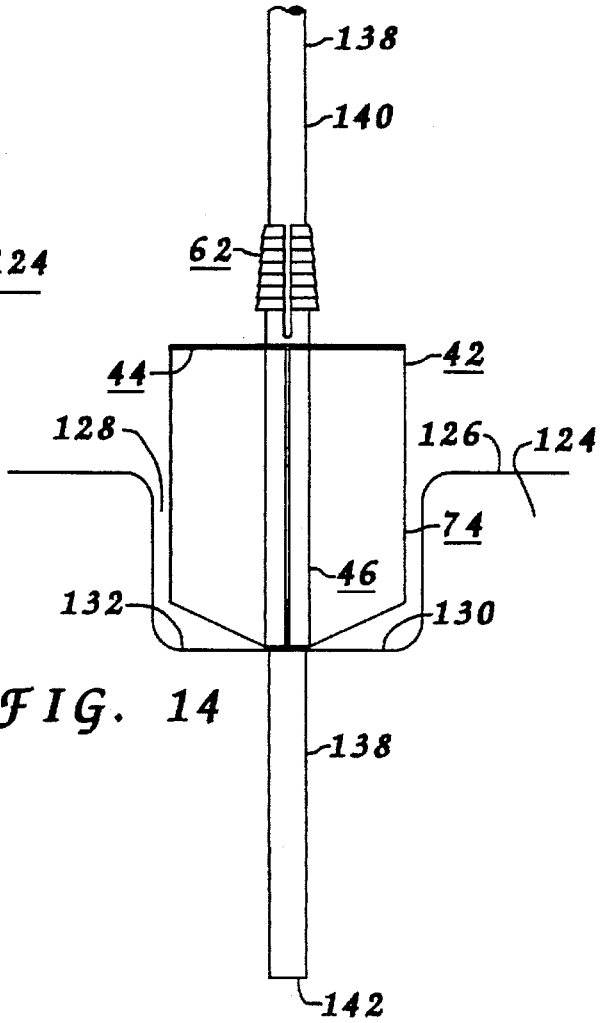

FIG. 14 represents the relative positioning of the various components regardless of the specific selection of the two previous steps. Post 138 has been driven to first driven depth 142. Driveable member 42 is slideably engaging post 138, using post engaging channel 46. Driveable member 42 rests on base 130 within excavated hole 128. At this point, post 138 acts as a guide to driveable member 42 when driveable member 42 is forced downward. Excavated grade 132 is of a minimum elevational distance from grade 126. This distance permits securing collar 62 extending above sub-grade surface 44 to be below grade 126 when sub-grade surface 44 rests on excavated grade 132.

Figure 15:
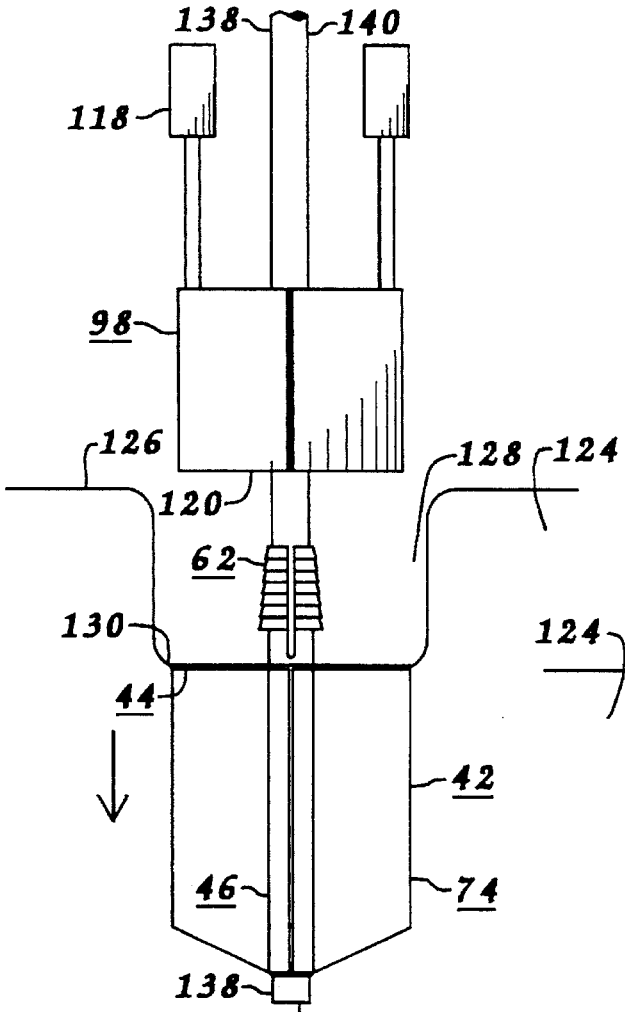

FIG. 15 depicts the impact insertion of driveable member 42 into earthen ground 124 while post 138 acts as a guide to ensure proper installation. Due to the cross section profile of post engaging channel 46 and ground engaging fins 74 insertion of driveable member 42 occurs with minimal earthen ground 124 displacement. A series of impact blows from driving member 98, with post 138 slidably guiding driving member 98, drives driveable member 42 into earthen ground 124. During these impact blows, an impact surface 120 of driving member 98 comes into contact with driveable member 42 to transfer the impact force. Delivery of such impact blows occurs until sub-grade surface 44 is firmly in contact with base 130. Additional impact blows may be desirable to allow the sub-grade surface to further compact the earthen ground around the ground engaging fins. Preferably, post 138 extends slightly below driveable member 42 when driveable member 42 is fully driven. This placement ensures adequate guiding properties during insertion.

Figure 16:
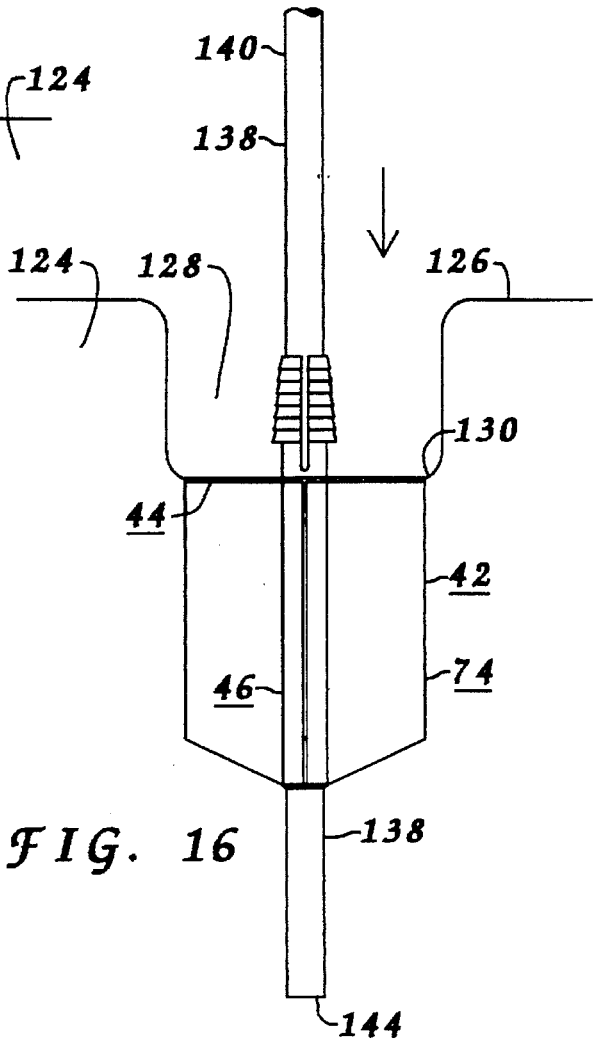

FIG. 16 depicts post 138 following a final driving operation placing post 138 at final driven depth 144. Post 138 may have initially been driven to final driven depth 144. Preferably, such driving occurs following full insertion of driveable member 42.

FIG. 17 depicts placement of locking member 90 on securing collar 62 to deform compression slots 64. This deforming of compression slots 64 provides for a secure friction grip. This grip is between inner surface 58 of post engaging channel 46, shown in FIG. 3, and an outer surface 140 of post 138. This gripping prevents vertical motion of post 138 relative to driveable member 42.

FIG. 18 depicts the final conditions following replacement of earthen ground 124 removed during forming of excavated hole 128. An earthen displacement bulge 136 remains extending slightly above grade 126 following the installation procedure. A post anchor 40, comprising driveable member 42 and locking member 90, is situated below grade 126. Ground engaging fins 74 cooperate with sub-grade surface 44 and the section of post 138 situated below grade 126 to resist movement of post 138 above grade 126.

It may be a requirement that installation of a post occur in close proximity to an obstruction, such as a wall or a sidewalk. In this instance, removal, by cutting, of sections of ground engaging fins and sub-grade surface permits installation at the desired position of placement.

Composite post anchors

The term composite within composite post anchor is used when a driveable member, being part of the post anchor, is formed of sheet material deformed by either a stamping process or a bending process. Use of the term linear juncture defines the radical surface change between adjacent panels on the same piece of sheet material. These changes may be between two planar surfaces, a planar surface and a curved surface or between two curved surfaces.

The sheet material may be of any resilient planar composition, as exampled by a metal or a plastic. The composition of the sheet material may allow a retention of the deformed shape following deformation. Alternatively, it may be a requirement that there be an exposure to a process to cause a retention of the deformed shape. Such a process is exampled by introduction of heat to a planar plastic sheet while held to the desired resultant shape.

Depending upon the deforming process, the composition of the sheet material and the outline pattern used, fastening connection between contacting panels may not be required. Generally, fastening connection is required between contacting panels and numerous methods exist to bond the contacting panels together. These methods include using adhesives, overlapping clamping binding, heat attachment and welding, including tack welding.

A single piece of sheet material may form the resultant driveable member. Preferably at least two pieces, and preferably two identical pieces to simplify the manufacturing process, of sheet material cooperate to form the driveable member. The disclosure which follows depicts three examples consisting of a single sheet and two sets of two identical sheets. Use of additional sheet materials, identical or unique, are applicable without departing from the disclosure of the instant invention. One example of this would be to form the ground engaging fins and the post engaging channel of one sized set of identical pieces bent or stamped to the proper shape. Then form the sub-grade surface out of a separate unique piece, preferably with an aperture for penetration of the post engaging channel.

The disclosure which follows depicts two sets each having two identical pieces of sheet material. The first set examples performance of a bending process on a sheet material along fold lines to certain angles of offset. A pair of these bent sheet materials then cooperate to combine to form the depicted driveable member. Identical results are obtainable by using a stamping process. The second set examples performance of a stamping process on a sheet material along stamping lines to certain angles of offset. These stamped units have curved surfaces thereon. A pair of these stamped sheet materials then cooperate to combine to form the depicted driveable member.

A third example depicts a deforming process, either bending or stamping, along fold lines to form a depicted driveable member from a single sheet material.

Preferably, any attachment connection between separate panels, either on one component or when attaching two components together, permits employment of tack welding for securement. This requires that the two attachment panels rest one on the other with the panel planes situated in parallel one to the other.

Sheet materials

A bending process permits deforming of sheet material wherein the resultant object has a plurality of planar surfaces defined from adjacent surfaces by sharp edges. A stamping process permits deforming of sheet material wherein the resultant object may have identical features as those formed by the bending process. In addition, the stamping process permits deforming of the sheet material to render certain curved surfaces, as compared to planar surfaces, on the resultant object. As disclosed above, a linear juncture separates each pair of the resultant adjacent panels defined by either process. Formation of the sub-grade surface may be from a single panel or even a single piece of sheet material.

1. Component deforming

Figure 19:
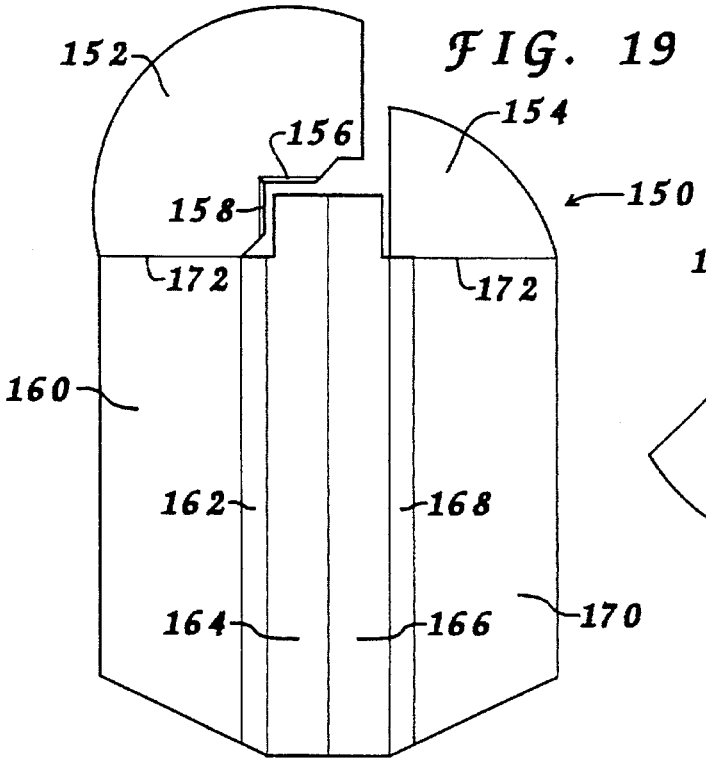
FIG. 19 is a plan view of a sheet material.
Figure 20:
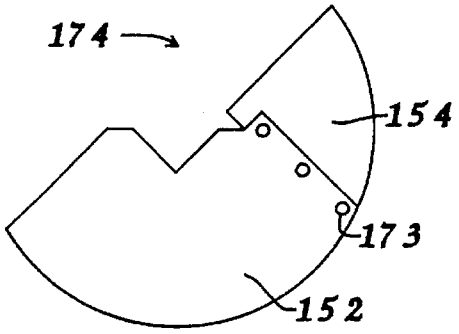
FIG. 20 is a top plan view, following a folding or stamping process, of a component formed by the sheet material shown in FIG. 19.
Figure 21:
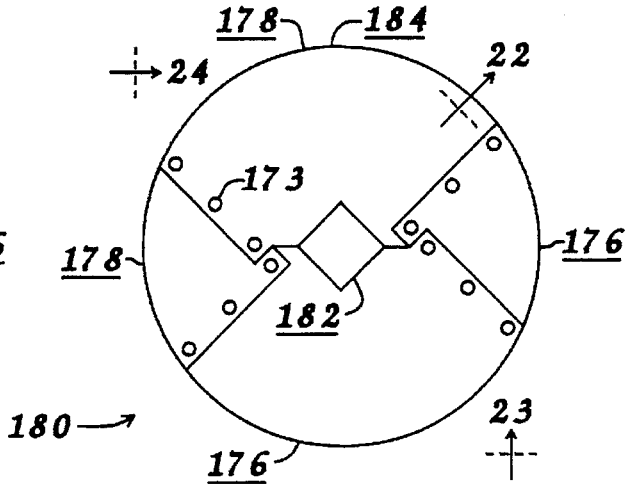
FIG. 21 is a top plan view of a driveable member of a composite post anchor following attachment of two of the components shown in FIG. 20.
Figure 23:
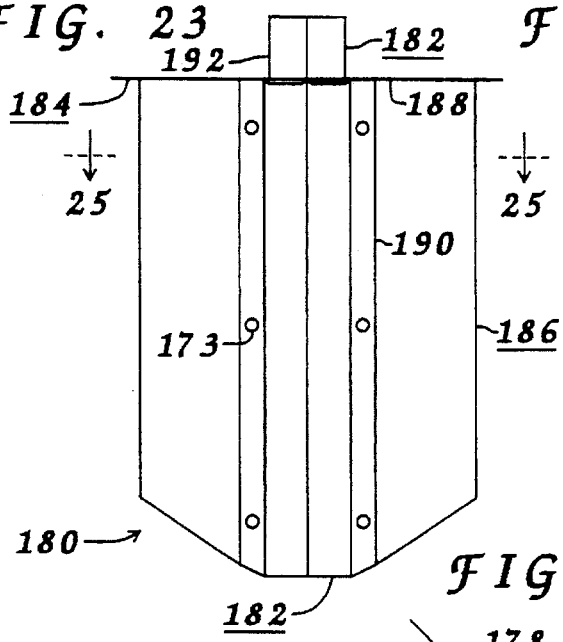
FIG. 23 is a side plan view as taken from the section line '23' shown in FIG. 21.
Figure 24:
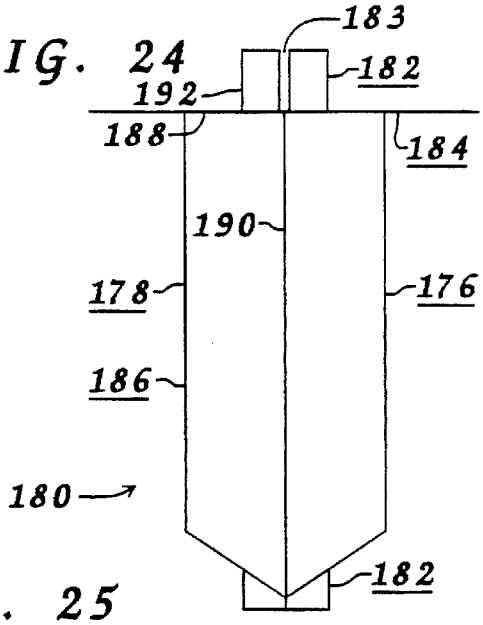
FIG. 24 is a side plan view as taken from the section line '24' shown in FIG. 21.

FIG. 19 depicts a sheet material 150 deformed to form driveable member 180, shown in FIG. 21, FIG. 23 and FIG. 24. All surfaces of driveable member 180 are planar without curvature thereof. The bolder lines indicate cut lines extending around the perimeter as well as two lines to cut not situated on the perimeter. These two cut lines not situated on the perimeter separate a panel 156 from a panel 158 and a panel 154 from a panel 168. The lighter lines are linear juncture lines to indicate where bending, either by a bending process or by a stamping process, occurs to form a component 174, shown in FIG. 20. A distinct reference numeral identifies each separate panel area. The description which follows sets out and explains the angles of offset between each adjacent set of panels. Numerous other patterns exist to form driveable members having the required features of the instant invention with these examples given only to explain the principles.

A panel 152 and panel 154 cooperate to define a portion of a sub-grade surface 184. Sub-grade surface 184 is circular and therefore panel 152 and panel 154 each have a circular shaped edge. Extending from panel 152 is panel 156 and panel 158 which both are bent upward to a ninety, (90), degree angle to panel 152. A panel 160 contacts panel 152 and forms one, (1), ground engaging fin 186. Panel 152 is bent upward to a ninety, (90), degree angle to panel 160. A panel 162 contacts panel 160 and is a contact panel with the opposing component 174. Tack welds 173 rigidly connect the pair of components 174 together along this panel. Panel 160 is bent upward to a forty-five, (45), degree angle to panel 162. A panel 164 contacts panel 162 and cooperates with other panels to define a post engaging channel 182. Panel 164 partially penetrates sub-grade surface 184 following assembly. Panel 164 is bent upward to a forty-five, (45), degree angle to panel 162. A panel 166 contacts panel 164 and cooperates with panel 164 to define half of post engaging channel 182. Panel 166 partially penetrates sub-grade surface 184 following assembly. Panel 166 is bent downward to a ninety, (90), degree angle to panel 164. Panel 168 contacts panel 166 and is a contact panel with the opposing component 174. Tack welds 173 rigidly connect the pair of components 174 together along this panel. Panel 168 is bent upward to a forty-five, (45), degree angle to panel 166. A panel 170 contacts panel 168 and forms one, (1), ground engaging fin 186. Panel 170 is bent upward to a forty-five, (45), degree angle to panel 168. Panel 154 contacts panel 170 and is bent downward to a ninety, (90), degree angle to panel 170.

The various bending steps may occur simultaneously, in select groups or individually. Following the various bending steps, panel 152 and panel 154 occupy nearly the same plane, with a slight overlapping. Panel 162 and panel 168 occupy the same plane. Panel 160 and panel 166, while not occupying the same plane, have their respective planes in parallel. Panel 164 and panel 170, while not occupying the same plane, have their respective planes in parallel.

Assembly

During assembly panel 152 overlaps panel 154 and tack welds 173 are used to rigidly connect the two panels, as shown in FIG. 21. Driveable member 180 comprises a first component 176 and a second component 178. First component 176 and second component 178 are each one, (1), component 174. Each panel 154 of the two components 174 will overlap panel 152 of the other component 174. Tack welds 173 rigidly connect the two components 174 at these two overlapping locations, as shown in FIG. 21. As mentioned above, panel 162 of each component 174 will contact panel 168 of the other component 174. Tack welds 173 rigidly connecting these contact panels, as shown in FIG. 23.

Each ground engaging fin 186 extends from one of the two panels 162 or one of the two panels 168. Tack welds 173 rigidly connect each of the two sets of contacts between panel 162 and panel 168 together. Therefore, anchoring of an inner edge 190, shown in FIG. 23, of each ground engaging fin 186 occurs. Each ground engaging fin 186 has an upper edge 188 which is a seam 172 with either one, (1), panel 152 or one, (1), panel 154. Adjacent each seam 172 an overlapping of the opposing panel 152 or panel 154 occurs. Tack welds 173 rigidly connect these overlapping positions. Therefore, anchoring of upper edge 188 of each ground engaging fin 186 occurs.

Following assembly, panel 156 and panel 158 contact panel 166 and panel 164 respectively directly below sub-grade surface 184. Panel 164 and panel 166 comprising one half of post engaging channel 182. Following assembly, the portions of panel 164 and panel 166 extending above sub-grade surface 184 provide for opposing compression slots 183, as shown in FIG. 24. Compression slots 183 permit compression deforming to secure driveable member 180 to a post 206, shown in FIG. 27 and FIG. 28.

Figure 22:
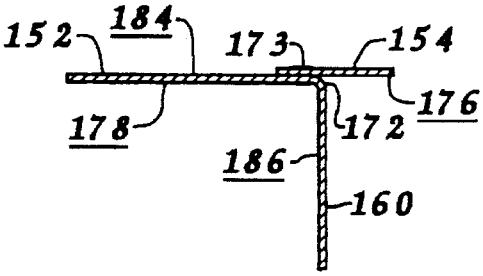
FIG. 22 is an enlarger sectional plan view as taken from the section line '22' shown in FIG. 21.

FIG. 22 depicts the overlapping feature associated with all connections between panels 152 and panels 154 on sub-grade surface 184. Panel 154 of first component 176 overlaps panel 152 of second component 178 and seam 172 of second component 178 common to panel 152 and panel 160. Tack welds 173 secure panel 152 and panel 154 together while providing for the structural integrity of ground engaging fin 186, in this case being panel 160.

Figure 25:
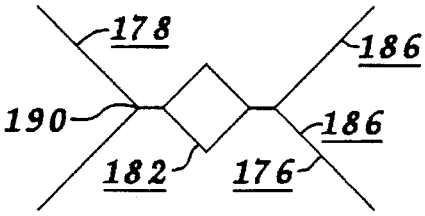
FIG. 25 is a sectional plan view as taken from the section lines '25' shown in FIG. 23.

FIG. 25 shows the cross section profile of driveable member 180 and clearly indicates that resistance to insertion into earthen ground is minimal. Displacement of earthen ground during installation similarly is minimal.

Post locking

The secure attachment of the driveable member of the composite post anchor to the post must occur. Numerous methods and structural elements exist to provide for this secure attachment. Employment of an insert to contact the upper extent of the post engaging channel to permit a locking member to deform a compression slot is a particularly expedient method of achieving this secure attachment. As detailed below it is preferable that the insert contact both sides of the sheet material adjacent the upper extent of the post engaging channel. While this surrounding contact is preferred, it is not required.

Figure 26:
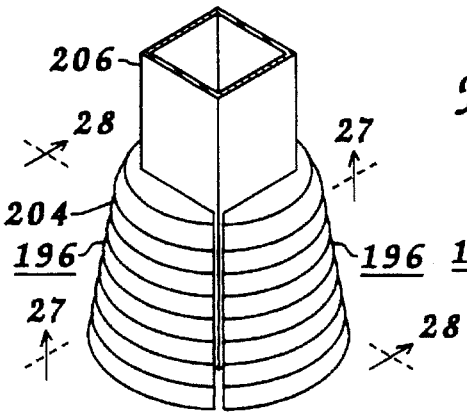
FIG. 26 is an enlarged perspective view of two securing collar clips positioned for securement on a post.
Figure 27:
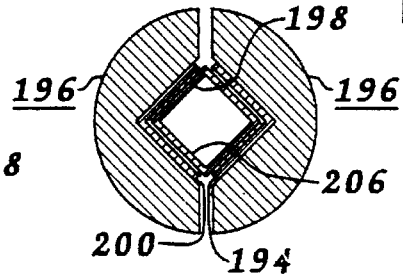
FIG. 27 is a bottom sectional plan view as taken from the section lines '27' shown in FIG. 26.
Figure 28:
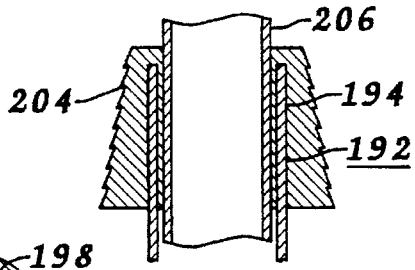
FIG. 28 is a sectional plan view as taken from the section lines '28' shown in FIG. 27.

FIG. 26 through FIG. 28 depict a pair of securing collar clips 196 adaptable for insertion, in a matching pair, over post engaging channel 182 extending above sub-grade surface 184, shown in FIG. 24. Intersecting post engaging channel slots 200 receive a sheet material wall 194 of an upper post engaging channel 192. Post 206, herein depicted as square, is securely gripped by opposing inner walls 198. This occurs when locking member 90, shown in FIG. 8, engages locking ridges 204 to apply a radially contracting pressure to opposing securing collar clips 196.

Similarly, the securing collar clip may have a curved sheet material slot to receive the post engaging channel. This accommodates the post engaging channel having a curved configuration, as shown in FIG. 30 through FIG. 33. When the post has a round cross section, preferably inner wall 198 has a rounded contour. Securing collar clip 196, or variations thereof, are applicable to any of the driveable members formed from sheet material. Other methods of securing the post to the driveable member may be employed without departing from the spirit of the invention.

2. Component stamping

Figure 29:
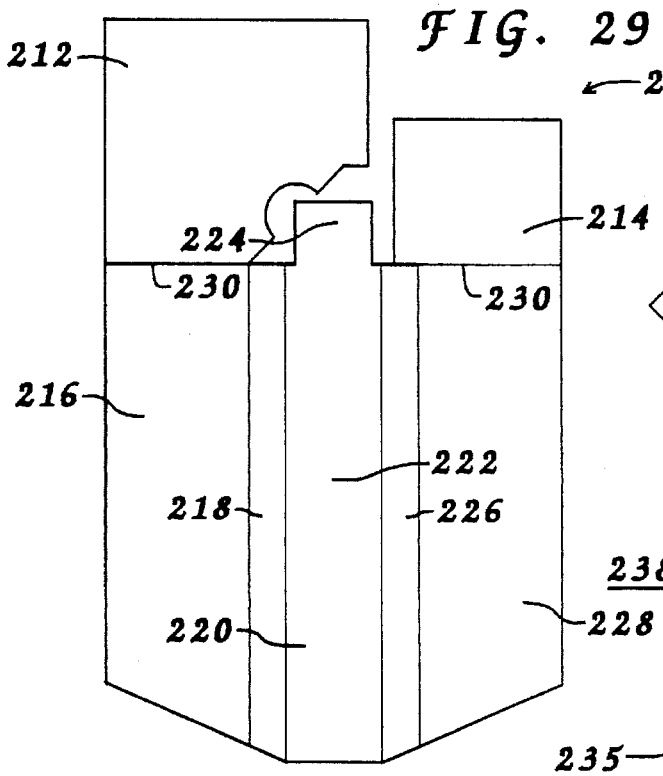
FIG. 29 is a plan view of a sheet material.
Figure 30:
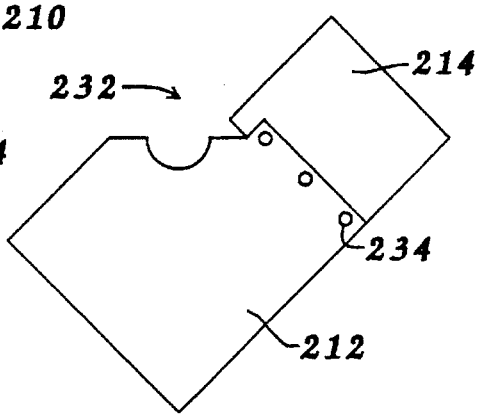
FIG. 30 is a top plan view, following a stamping process, of a component formed by the sheet material shown in FIG. 29.
Figure 33:
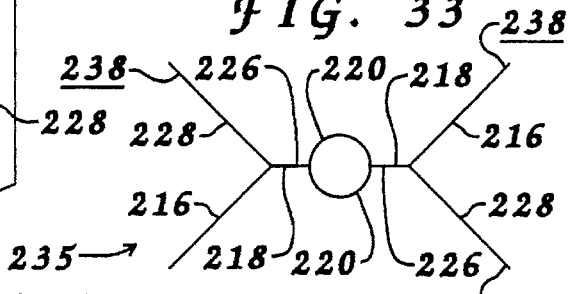
FIG. 33 is a sectional plan view as taken from the section lines '33' shown in FIG. 31.
Figure 31:
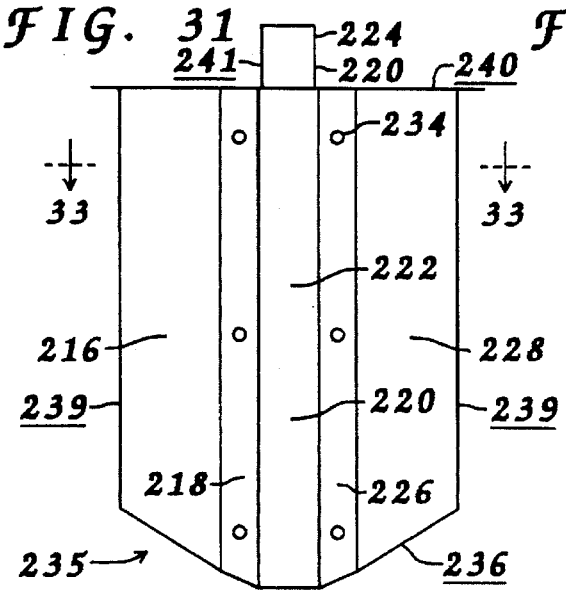
FIG. 31 is a side plan view of a driveable member of a composite post anchor formable by combining two of the components shown in FIG. 30.
Figure 32:
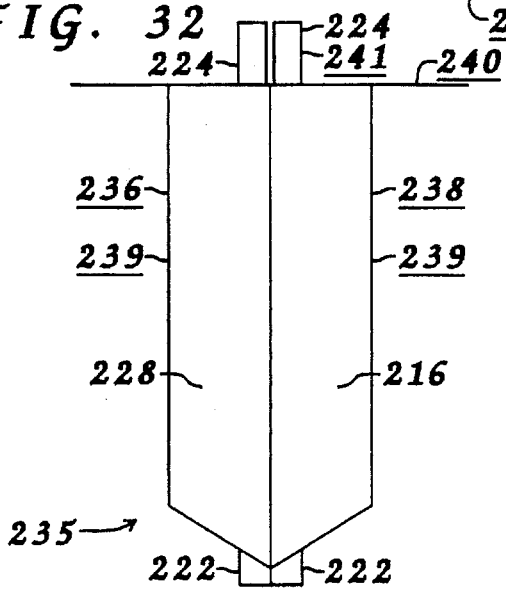
FIG. 32 is a side plan view of the driveable member shown in FIG. 31.

FIG. 29 depicts a sheet material 210 capable of deforming by a stamping process to form driveable member 235, shown in FIG. 31 through FIG. 33. FIG. 29 shows the outline of sheet material 210, required in a matching pair, to form driveable member 235. Most surfaces of driveable member 235 are planar without curvature thereof while two surfaces have a curvature thereon. The bolder lines indicate cut lines extending around the perimeter and one line to cut not situated on the perimeter. This cut line separates a panel 214 from a panel 226. The lighter lines are bend lines to indicate where bending, either by a bending process or by a stamping process, occurs. This bending forms a component 232, shown in FIG. 30. A distinct reference numeral identifies each separate panel area. The description which follows sets out and explains the angles of offset between each adjacent set of panels.

A panel 212 and panel 214 cooperate to define a portion of a sub-grade surface 240. Sub-grade surface 240 is square and therefore panel 212 and panel 214 each have straight edges. A panel 216 contacts panel 212 and forms one, (1), ground engaging fin 239. Panel 212 is bent upward to a ninety, (90), degree angle to panel 216. A panel 218 contacts panel 216 and is a contact panel with the opposing member of the pair of components 232. Tack welds 234 rigidly connect the pair of components 232 together along this panel. Panel 216 is bent upward to a forty-five, (45), degree angle to panel 218. A panel 220 is deformed to have a curved shape during the stamping process. Panel 220 contacts panel 218 and cooperates with the corresponding panel on the matching component 232 to define a post engaging channel 241. Panel 220 partially penetrates sub-grade surface 240 following assembly with an upper panel 224 extending above sub-grade surface 240 and a lower panel 222 extending below sub-grade surface 240. Panel 226 contacts panel 220 and is a contact panel with the opposing member of the pair of components 232. Tack welds 234 rigidly connect the pair of components 232 together along this panel. Panel 226 and panel 218 exist on the same plane. A panel 228 contacts panel 226 and forms one, (1), ground engaging fin 239. Panel 228 is bent upward to a forty-five, (45), degree angle to panel 226. Panel 214 contacts panel 228 and is bent downward to a ninety, (90), degree angle to panel 228.

The various bending steps may occur simultaneously, in select groups or individually. Following the various bending steps, panel 212 and panel 214 occupy nearly the same plane, with a slight overlapping. Panel 218 and panel 226 occupy the same plane.

Assembly

During assembly panel 212 overlaps panel 214 and tack welds 234 are used to rigidly connect the two panels, as shown in FIG. 30. Driveable member 235 comprises a first component 236 and a second component 238. First component 236 and second component 238 are each one, (1), component 232. Each panel 214 of the two components 232 will overlap panel 212 of the other component 232. Tack welds 234 rigidly connect the two components 232 at these two overlapping locations, not shown. As mentioned above, panel 218 of each component 232 will contact panel 226 of the other component 232. Tack welds 234 rigidly connecting these contact panels, as shown in FIG. 31. Opposing compression slots 225 separate the then opposing upper panels 224, as shown in FIG. 32. Compression slots 225 permit the application of contracting radial pressure to deform post engaging channel 241 to rigidly contact a post, not shown, situated therein.

Each ground engaging fin 239 extends from one of the two panels 212 or one of the two panels 214. Tack welds 234 rigidly connect each of the two sets of contacts between panel 218 and panel 226 together. Adjacent each seam 230 an overlapping of the opposing panel 212 or panel 214 occurs. Tack welds 234 rigidly connect these positions.

FIG. 33 shows the cross section profile of driveable member 235 and clearly indicates that resistance to insertion into earthen ground is minimal. Displacement of earthen ground during installation similarly is minimal.

3. Single piece deforming

Figure 34:
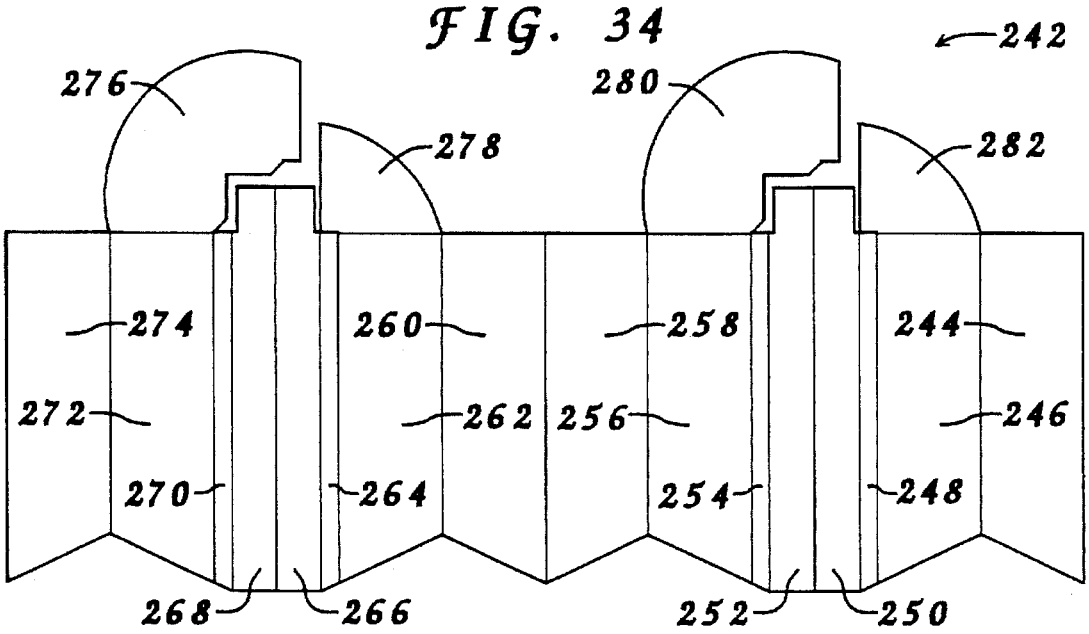
FIG. 34 is a plan view of a sheet material.
Figure 35:
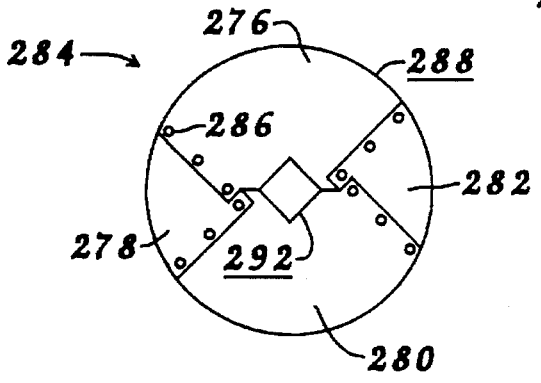
FIG. 35 is a top plan view, following a folding or stamping process, of a driveable member formed by the sheet material shown in FIG. 34.
Figure 36:
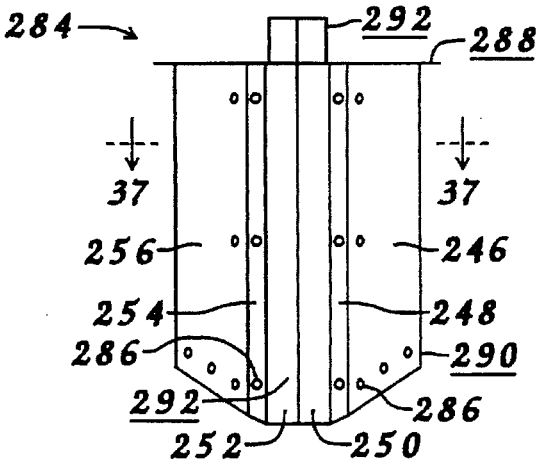
FIG. 36 is a side plan view of the driveable member shown in FIG. 35.
Figure 37:
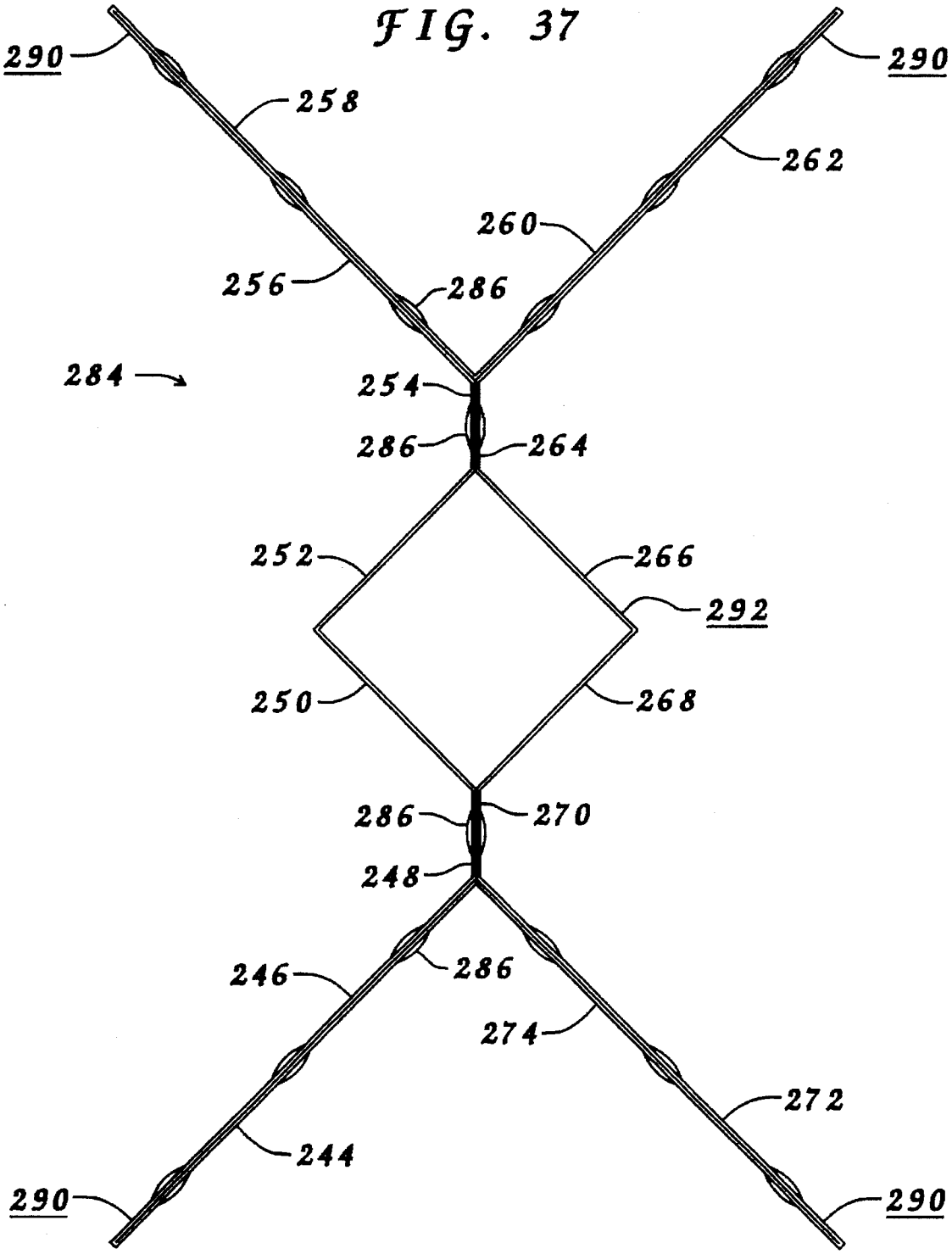
FIG. 37 is an enlarged section view as taken from the section lines '37' shown in FIG. 36.

FIG. 34 depicts a sheet material 242 capable of deforming, either by a bending process or by a stamping process. Such deforming forms driveable member 284, shown in FIG. 35 through FIG. 37. Following the deforming a panel 276, a panel 278, a panel 280 and a panel 282 form a sub-grade surface 288, as shown in FIG. 35. Each of these panels 276, 278, 280 and 282 have an overlapping contact with one of the other panels 276, 278, 280 or 282. Tack welds 286 secure and reinforce these contacts. A panel 244 contacts a panel 246 and form one, (1), ground engaging fin 290. A panel 256 contacts a panel 258 and form one, (1), ground engaging fin 290. A panel 260 contacts a panel 262 and form one, (1), ground engaging fin 290. A panel 272 contacts a panel 274 and form one, (1), ground engaging fin 290. Tack welds 286 secure and reinforce these contacts, as shown in FIG. 37. A panel 248 contacts a panel 270 while a panel 254 contacts a panel 264. Tack welds 286 similarly secure and reinforce these contacts. A panel 250, a panel 252, a panel 266 and a panel 268 cooperate to form a post engaging channel 292 which extends below and above sub-grade surface 288. Additional tack welds 286 secure the lower extent of each ground engaging fin 290 to prevent separation during insertion into the earthen ground.

Ground engaging fin and sub-grade surface example configurations

Many configurations exist for the ground engaging fins and the sub-grade surface of the instant invention depending, in part, upon intended use. Below is an explanation of several examples of vertical outlines and outline profiles. Many patterns exist and the following examples depict only a few selected from the many.

1. Vertical outline and placement configurations

The vertical outline refers to the bottom view of the driveable member. The only requirement is that there be a linear alignment of the planes to permit easy insertion into the earthen ground without undue resistance.

Figure 38A:
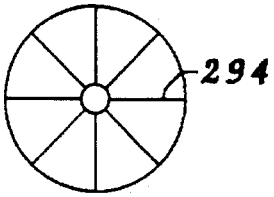
FIG. 38*a* through FIG. 38*l* are bottom plan views of several examples of the vertical outlines and the placement configurations of the ground engaging fins and examples of various configurations of sub-grade surfaces.
Figure 38B:
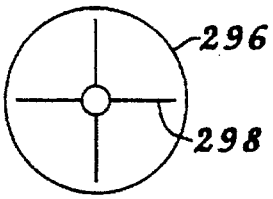
Figure 38C:
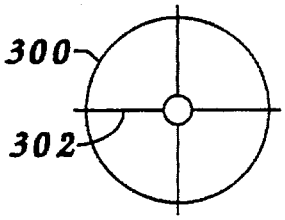
Figure 38D:
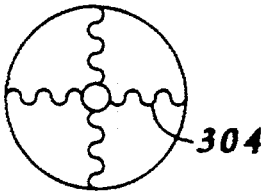
Figure 38E:
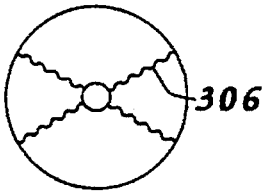
Figure 38F:
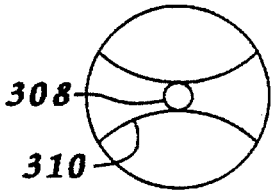
Figure 38G:
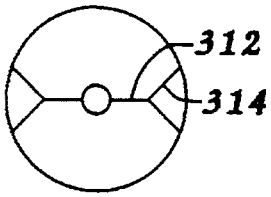
Figure 38H:
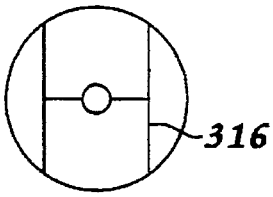
Figure 38I:
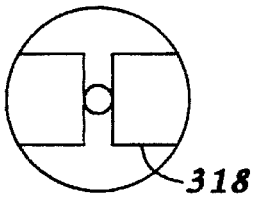
Figure 38J:
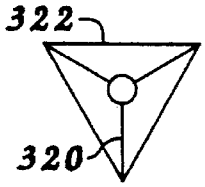
Figure 38K:
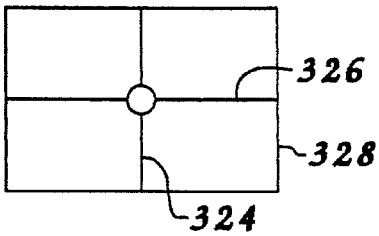
Figure 38L:
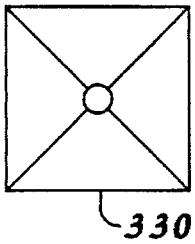

FIG. 38*a* through FIG. 38*l* depict several different configurations of ground engaging fins and several shapes of the sub-grade surfaces. FIG. 38*a* depicts eight, (8), ground engaging fins 294. FIG. 38*b* depicts ground engaging fins 298 which do not extend completely to the perimeter of a sub-grade surface 296. FIG. 38*c* depicts ground engaging fins 302 which extend beyond the perimeter of a sub-grade surface 300. FIG. 38*d* depicts ground engaging fins 304 having a corrugated shape to enhance strength. FIG. 38*e* depicts a non uniform distribution of ground engaging fins 306. FIG. 38*f* depicts ground engaging fins 310 which have a curved outline and which do not terminate inward at a post engaging channel 308. FIG. 38*g* depicts a central expanding common wall 312 partially forming each ground engaging fin 314. FIG. 38*h* depicts another configuration of ground engaging fins 316. FIG. 38*i* depicts yet another configuration of ground engaging fins 318. FIG. 38*j* depicts three, (3), ground engaging fins 320 and a sub-grade surface 322 having a triangular shape. FIG. 38*k* depicts a sub-grade surface 328 having a rectangular shape and opposing narrow ground engaging fins 324 and opposing broad ground engaging fins 326. Therefore, FIG. 38*k* depicts the use of two distinct widths of ground engaging fins. FIG. 38*l* depicts a sub-grade surface 330 having a square shape.

2. Outline profiles

Figure 39A:
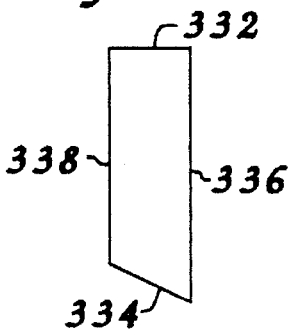
FIG. 39*a* through FIG. 39*h* are side plan views of several examples of the outline profiles of the ground engaging fins.
Figure 39B:
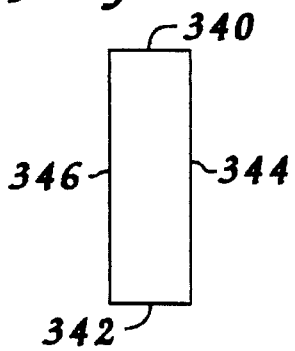
Figure 39C:
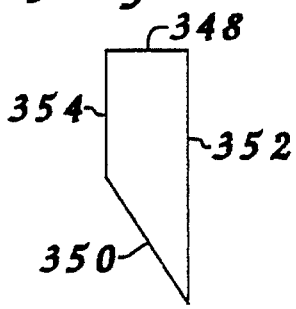
Figure 39D:
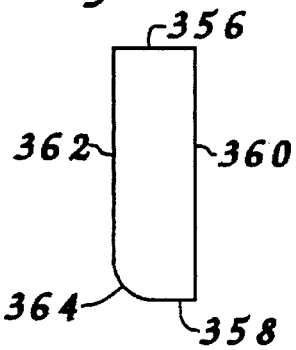
Figure 39E:
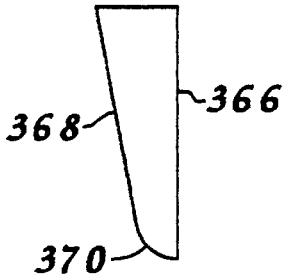
Figure 39F:
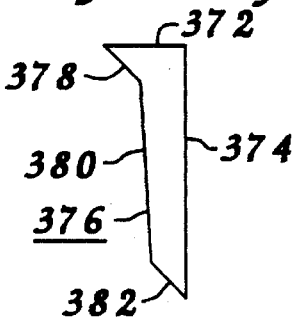
Figure 39G:
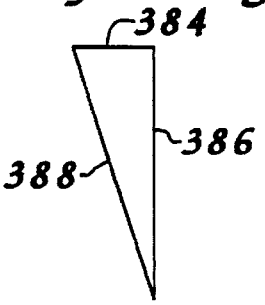
Figure 39H:
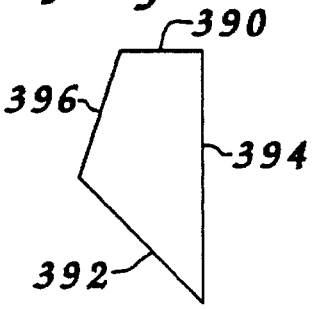

The outline profile refers to a side view of the ground engaging fin. FIG. 39*a* through FIG. 39*h* depict several different shapes of the ground engaging fins. FIG. 39*a* depicts an outer edge 338 which is parallel to an inner edge 336 and a lower edge 334 which is angularly offset from an upper edge 332. FIG. 39*b* depicts an outer edge 346 which is parallel to an inner edge 344 and a lower edge 342 which is parallel to an upper edge 340. FIG. 39*c* depicts an outer edge 354 which is parallel to an inner edge 352 and a lower edge 350 which is significantly angularly offset from an upper edge 348. FIG. 39*d* depicts an outer edge 362 which is parallel to an inner edge 360 and a lower edge 358 which is parallel to an upper edge 356 and a curved transition 364 between lower edge 358 and outer edge 362. FIG. 39*e* depicts an outer edge 368 which is angularly offset from an inner edge 366 and a curved transition 370, which merges outer edge 368 with inner edge 366. FIG. 39*f* depicts an inner edge 374, an upper edge 372 and a compound side 376 comprised of a first edge 378, a second edge 380 and a third edge 382. FIG. 39*g* depicts an inner edge 386, an upper edge 384 and a side edge 388 directly connecting the lower terminus of inner edge 386 and the outer terminus of upper edge 384. FIG. 39*h* depicts an outer edge 396 which is angularly offset outward to an inner edge 394 and a lower edge 392 which is significantly angularly offset from an upper edge 390.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A post anchor to provide for securing a post vertically oriented in earthen ground, the post having an outer surface and extending above grade following installation, the post anchor comprising:

a) a driveable member adaptable for impact driven insertion into the earthen ground during installation, the driveable member comprising:

1) a post engaging channel to receive the post, the post engaging channel having a first end, a second end situated opposite from the first end, an outer surface and an open passage connecting the first end and the second end, the open passage having an inner surface, the open passage to receive the post;

2) a plurality of ground engaging fins, each ground engaging fin contacting the outer surface of the post engaging channel and having a vertical orientation during and following installation of the driveable member, each ground engaging fin to provide for resistance to horizontal displacement through the earthen ground following installation, each ground engaging fin having an upper edge;

3) a sub-grade surface extending outward generally perpendicularly from the post engaging channel, the post engaging channel extending through the sub-grade surface with the first end of the post engaging channel partially extending above the sub-grade surface, the upper edge of each ground engaging fin at least partially secured to the sub-grade surface, the sub-grade surface wherein to provide for compaction of the earthen ground during installation and resistance to displacement of the earthen ground following installation;

b) locking means to provide for securing the post situated within the post engaging channel to the driveable member;

whereby the driveable member provides for impact driven insertion into the earthen ground where the post may be secured within the post engaging channel using the locking means to prevent vertical motion of the post relative to the driveable member while the ground engaging fins and the sub-grade surface cooperate to provide resistance to motion of the post following installation;

c) a compression slot situated in said post engaging channel proximate the first end and extending longitudinally a predetermined distance along the length of said post engaging channel toward the second end, wherein the locking means provides for a compression of said post engaging channel proximate said compression slot to bring a portion of the inner surface of said post engaging channel into contact with a portion of the outer surface of the post.

2. The post anchor defined in claim 1 further comprising a raised section extending radially around the first end of said post engaging channel proximate the compression slot; and wherein the locking means comprises a ring shaped member to provide for radially contacting the raised section proximate the compression slot to provide the compression of the post engaging channel.

3. The post anchor defined in claim 1 wherein the driveable member is of a one piece construction.

4. The post anchor defined in claim 1 wherein the second end of the post engaging channel further comprises a lower extent and the lower extent is tapered from the inner surface to the outer surface to provide for ease of insertion into the earthen ground during installation.

5. The post anchor defined in claim 1 wherein each ground engaging fin further comprises a lower edge, a first side and a second side, the lower edge angled upward toward the sub-grade surface while extending outward from the post engaging channel and the lower edge is tapered between the first side and the second side to provide for ease of insertion into the earthen ground during installation.

6. A method of installing a post into earthen ground to a final driven depth, the earthen ground having a grade, the method comprising the steps of:

a) providing a post anchor comprising:

1) a driveable member comprising:

a) the post engaging channel to provide for slidably receiving the post;

b) a plurality of ground engaging fins, each ground engaging fin disposed about the post engaging channel and having a vertical orientation during and following installation of the driveable member, each ground engaging fin to provide for resistance to displacement of the driveable member through the earthen ground following installation;

c) a sub-grade surface having a horizontal orientation during and following installation of the driveable member, the post engaging channel extending through the sub-grade surface, each ground engaging fin securely connected to the sub-grade surface, the sub-grade surface to provide for resistance to displacement of the driveable member through the earthen ground following installation;

2) a locking member to provide for locking a post within said post engaging channel of the driveable member at a desired elevational position relative to the driveable member;

b) then, locating a desired position of placement of the post;

c) then, excavating a hole at the desired position of placement having a diametric measurement greater than the diametric measurement of the sub-grade surface of the driveable member, the excavated hole having a base, the base having an excavated grade;

d) then, positioning the post and the driveable member into the excavated hole with the post driven to a depth not exceeding the final driven depth;

e) then, driving the driveable member to place the sub-grade surface below the grade of the earthen ground to bring the sub-grade surface into contact with the excavated grade within the excavated hole while the post acts as a guide for the driveable member;

f) then, driving the post to the final driven depth;

g) then, positioning the locking member to secure the post to the driveable member;

h) then, filling the excavated hole with soil to cover the driveable member and the locking member;

whereby the position of placement of the post is located, then excavation of a shallow hole occurs at this location, then the post and the driveable member are positioned into the excavated hole with the post driven to a depth not exceeding the desired final driven depth, then the driveable member is driven into the earthen ground to place the sub-grade surface into contact with the excavated grade while the post acts as a guide, then the post is driven to the final driven depth, then the locking member is positioned to secure the post to the driveable member and then the excavated hole is filled to cover the driveable member and the locking member.

7. The method defined in claim 6 wherein prior to step 'd' the post is driven into the earthen ground then the driveable member is inserted over an exposed end of the post and is then slid down to contact the earthen ground.

8. The method defined in claim 6 wherein prior to step 'd' the driveable member is placed within the excavated hole and then the post is inserted through the driveable member and then driven into the earthen ground.

9. The method defined in claim 6 wherein the driveable member is of a one piece construction.

* * * * *